US005115607A

United States Patent [19]

Pirozzoli et al.

[11] Patent Number: 5,115,607

[45] Date of Patent: May 26, 1992

[54] CASKET ENCLOSURE AND METHOD OF STORING SAME IN A BURIAL CRYPT

[75] Inventors: Richard W. Pirozzoli, Reading; Robert J. Pirozzoli, Huntington; Alexander P. Pirozzoli, Trumbull, all of Conn.

[73] Assignee: Norwalk Vault Company of Bridgeport, Inc., Bridgeport, Conn.

[21] Appl. No.: 696,231

[22] Filed: May 6, 1991

[51] Int. Cl.[5] ..... E04H 13/00

[52] U.S. Cl. ..... 52/134; 52/136; 52/741

[58] Field of Search ..... 52/128-140, 52/741; 27/7, 35, 2, 20, 27

[56] References Cited

U.S. PATENT DOCUMENTS

| | | | |
|---|---|---|---|
| 2,579,756 | 12/1951 | Reed | 27/7 |
| 2,617,171 | 11/1952 | Kimmel | 27/7 |
| 3,439,461 | 4/1969 | Chandler | 52/309.15 |
| 3,839,768 | 10/1974 | McQuestion | 52/135 |
| 3,898,718 | 8/1975 | Eubank | 27/7 |
| 3,986,308 | 10/1976 | Jones | 52/136 |
| 4,607,417 | 8/1986 | Hancovsky | 52/137 |
| 4,727,632 | 3/1988 | Yearsley | 27/7 |

OTHER PUBLICATIONS

Engineering Properties and Applications by Gilbert Kinney 1957 p. 31.

*Primary Examiner*—John E. Murtagh
*Attorney, Agent, or Firm*—John R. Doherty

[57] ABSTRACT

A method of storing an enclosed entombment casket in the chamber of an above-ground burial crypt is provided wherein a compact, lightweight casket enclosure made from a thermoplastic resinous material which is impervious to gases and liquids and which is chemically resistant to the highly corrosive liquids used in the embalming process, notably formaldehyde, is first placed into the crypt chamber and positioned so that it will be completely contained inside the chamber with an open end located close to but spaced from the entrance opening of the chamber. The enclosed entombment casket is then inserted into the casket enclosure through its open end which is then closed and sealed by a gas and liquid impermeable cover made from the same thermoplastic resinous material. The cover is provided with a generally U-shaped sealing channel disposed around its outer periphery which is adapted to receive in an abutting relationship the peripheral edges of the casket enclosure which surround the open end. The abutting peripheral edges of the casket enclosure are sealed inside the U-shaped channel by a chemical bonding agent. The chemical bonding agent is capable of dissolving the thermoplastic resinous material and forming a chemical bond which is tough and strong and impervious to gases and liquids and which is highly resistant to chemical attack by corrosive embalming liquids.

14 Claims, 4 Drawing Sheets

FIG. 1
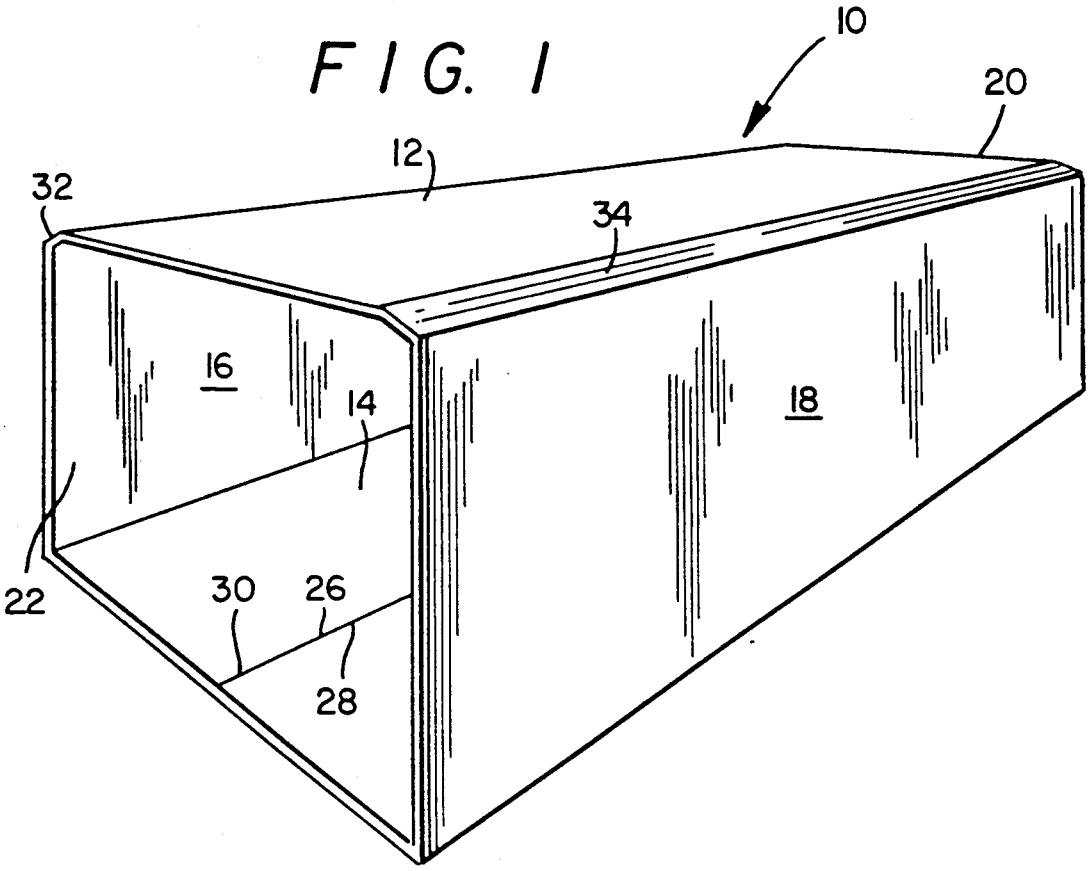
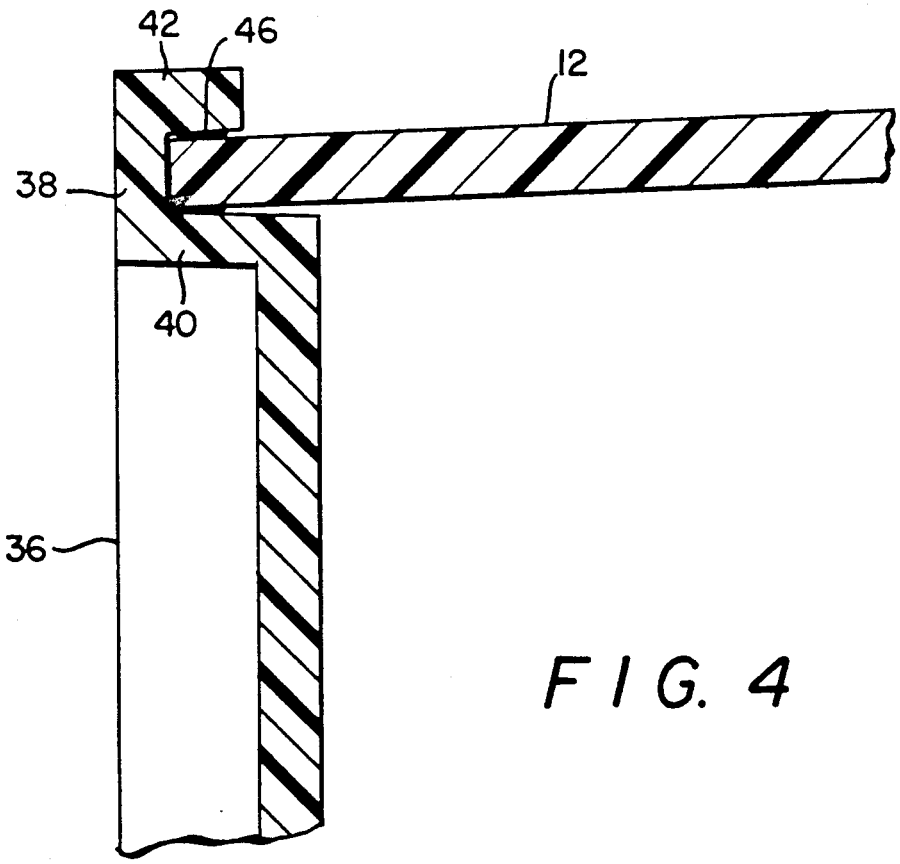
FIG. 4

CASKET ENCLOSURE AND METHOD OF STORING SAME IN A BURIAL CRYPT

BACKGROUND OF THE INVENTION

This invention relates to the storage of enclosed, entombment caskets in burial vaults and especially above-ground burial vaults more commonly referred to as mausoleum crypts and to a novel and unique, compact, lightweight, hermetically sealed casket enclosure for use in such storage systems. More particularly, the invention relates to an improved method of storing an enclosed, entombment casket in a mausoleum crypt which does not require the casket enclosure to be completely sealed prior to placing the enclosure inside the crypt.

Storage of enclosed, entombment caskets in mausoleum crypts has become more popular in recent years due to the ever-increasing shortages of available space for below ground burials in most cemeteries. However, these interments have been plagued by certain serious problems which unfortunately have limited their more wide spread use. One such problem, for example, has been the necessity to provide proper ventilation throughout the mausoleum crypt in order to mask or suppress odors created by the decomposition gases. Another more serious problem has been the rapid deterioration of the crypt chambers when the casket decays and begins to leak corrosive compounds including embalming solutions containing formaldehyde, for example, and other corrosive chemicals produced by decomposition of the remains. Unless strict measures are followed to ensure complete and long term sealing of the caskets within suitable containers or enclosures when placed inside the crypt, such corrosive compounds can quickly act to degrade the materials used to make the crypt chambers, e.g. concrete, eventually leading to destruction of the entire crypt.

U.S. Pat. No. 4,922,590 issued to David Yearsley on May 8, 1990 discloses a compact, lightweight casket enclosure system for use in a burial or mausoleum crypt. The casket enclosure comprises essentially two pieces, namely, a rigid, foldable, bottom tray for receiving the casket and a durable cover made from a rugged, chemically resistant, gas and liquid impermeable wrapping material. The cover is placed over the top of the casket much like a dome and is sealed longitudinally around the bottom or side wall of the casket by a gas and liquid impermeable adhesive tape. The problem with this type of casket enclosure is that it must be assembled and completely sealed around the casket before the casket and the enclosure are placed inside the crypt chamber. The reason for this requirement is that the crypt chamber is usually only slightly larger in size than the casket enclosure and there is little, if any, room left inside the crypt to accommodate any kind of sealing equipment. Thus, the enclosure must be sealed outside the crypt chamber and then lifted with the casket in place and inserted into the crypt chamber. This maneuver, if not carefully done, can result in damage to the casket and/or the enclosure should the casket, for example, slide around inside the enclosure while being lifted.

It has been proposed more recently to fabricate a casket enclosure from a single sheet of a thermoplastic resinous sheet material which is shaped into an elongated configuration having open ends that are closed by flat end covers or the like. The casket enclosure is hermetically sealed by applying a torch or other heating device around the periphery of the cover to melt the resin and heat seal the junction between the cover and the enclosure walls. Although this type of casket enclosure is simple, easy to assemble and durable in construction, it is still necessary to hermetically seal the enclosure outside of the crypt chamber since there would be no room left to accommodate a heating device after the enclosure has been loaded into the crypt.

Other prior art patents which exemplify the state of the art include U.S. Pat. Nos. 4,253,220, 4,288,952 and 4,845,906. These patents disclose burial vaults which include a base and dome type covers made from tough and durable plastic resinous materials. The covers are hermetically sealed to the base longitudinally around the side walls of the casket using a gasket type sealing material.

SUMMARY OF THE INVENTION

The invention is directed to a method of storing an enclosed entombment casket in the chamber of an above-ground burial vault or crypt and to an improved compact, lightweight, hermetically-sealed casket enclosure for use in the practice of such method. The casket enclosure of the invention is made from a thermoplastic resinous material which is impervious to both gases and liquids, which is flexible and yet tough enough to permit expansion of the enclosure upon the build-up of decomposition gases that occurs over time and which is chemically resistant to such gases and liquids and especially the highly corrosive liquids that are used in the embalming process, notably formaldehyde. The crypt chamber is typically a generally elongated, rectangular configuration having top, bottom and opposite side walls and has an opening at one end which serves as an entrance to the chamber. The casket enclosure of the invention is similarly of a generally elongated, rectangular configuration having top, bottom and side walls and opposite ends which are closed and sealed by end covers. The casket enclosure is dimensioned so that the entire enclosure will fit compactly within the crypt chamber with a minimum of free space and with one end thereof lift open for insertion of the enclosed entombment casket.

The method of the invention is carried out by first placing an empty casket enclosure into the crypt chamber and positioning the enclosure so that it will be completely contained inside the chamber with its open end located close to but spaced from the entrance opening of the chamber. The enclosed entombment casket is then inserted through the open end of the casket enclosure which is then closed and sealed. Ordinarily, it would be extremely difficult, if not impossible, to close and seal the open end of the casket enclosure using the prior art methods and structure, such as by heat sealing the end cover around the open end of the enclosure, since space is limited inside the crypt chamber and there would no room to accommodate the required heat sealing equipment. However, according to the invention, the casket enclosure is closed and sealed by placing over its open end, after the enclosure has been placed into the chamber, a gas and liquid impermeable cover made from a thermoplastic resinous material. The cover is provided with a generally U-shaped sealing channel disposed around its outer periphery which is adapted to receive in an abutting relationship the peripheral edges of the top, bottom and side walls of the casket enclosure which surround the open end. The abutting peripheral edges of the casket enclosure are sealed inside the U-shaped channel by placing therebetween a chemical bonding agent which is capable of dissolving the plastic resinous material and forming a chemical bond at the abutting juncture which is extremely tough and strong and impervious to gases and liquids and which is highly resistant to chemical attack by corrosive embalming liquids and to leakage of such liquids and decomposition gases over an indefinite period of time.

BRIEF DESCRIPTION OF THE DRAWINGS

In the accompanying drawings:

FIG. 1 is a perspective view of the casket enclosure embodying the invention, the enclosure being shown with one end closed and the other left open for insertion of the casket;

FIG. 4 is an enlarged cross sectional view of part of the sealed casket enclosure showing the juncture between the end cover and one wall of the enclosure;

DESCRIPTION OF THE PREFERRED EMBODIMENTS

Figure 3:
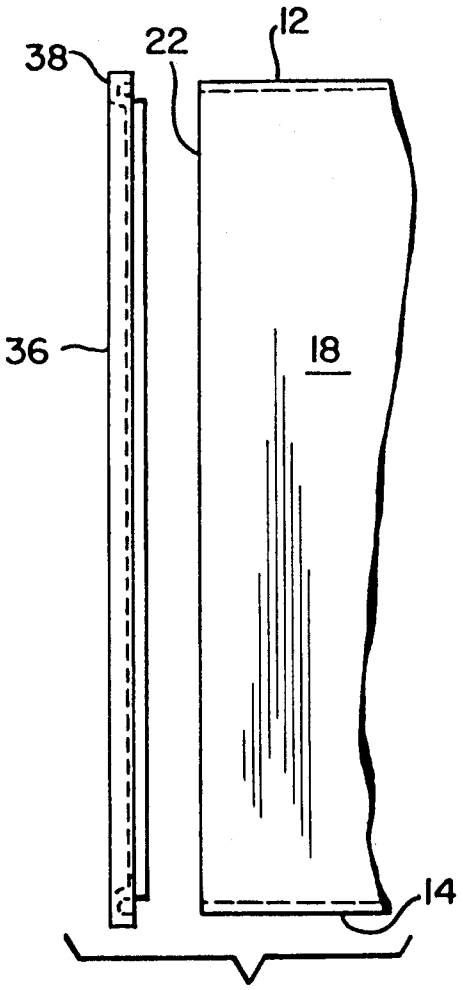
FIG. 3 is an exploded view of the end cover and part of the casket enclosure adjacent to the open end thereof.
Figure 2:
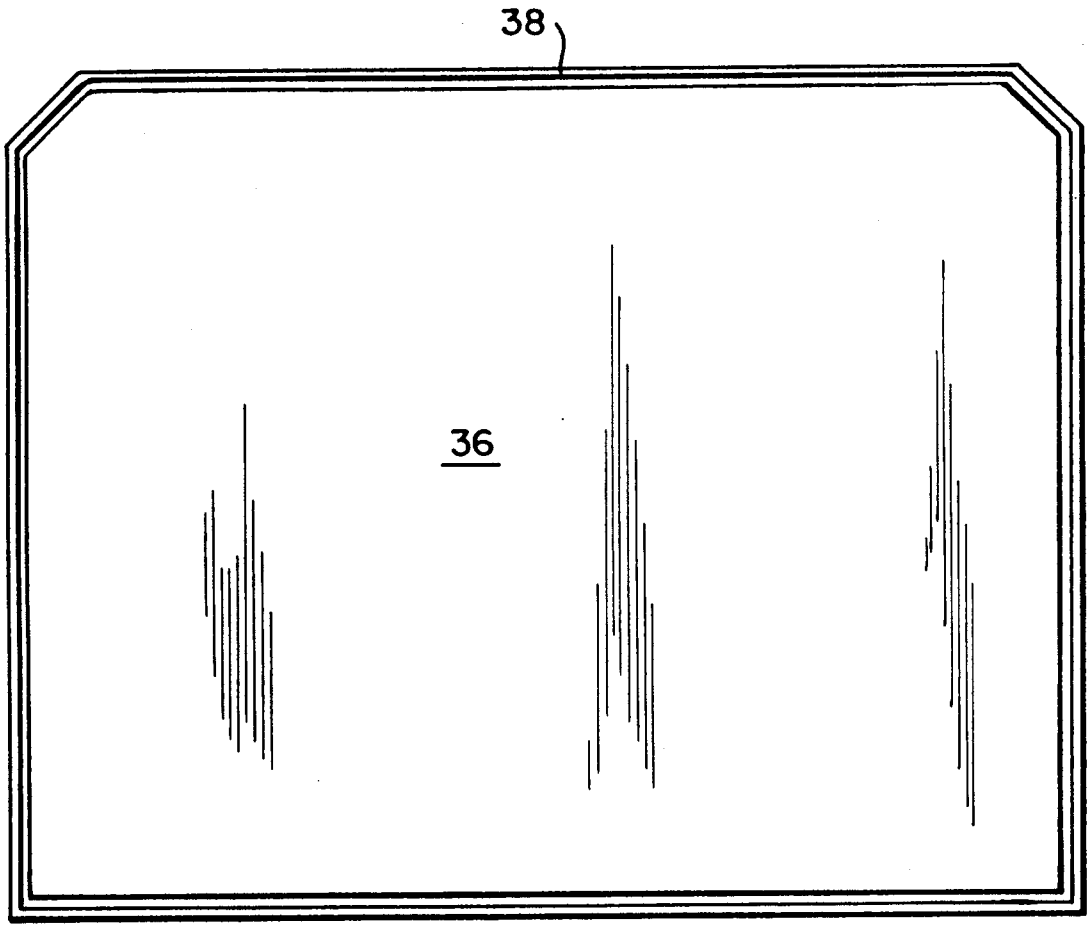
FIG. 2 is an enlarged elevational view of an end cover for closing the open end of the casket enclosure shown in FIG. 1.

Referring now to the drawing and particularly to FIGS. 1-3, inclusive, a compact, lightweight, hermetically sealed casket enclosure embodying the invention is generally designated by the reference numeral 10. As shown, the casket enclosure 10 is a generally elongated, rectangular, thin wall, box-like container having a top wall 12, bottom wall 14 and opposite side walls 16, 18, the enclosure being shown in the view of FIG. 1 having a closed end 20 and an opposite end 22 which is left open to receive an elongated, enclosed, entombment casket 24 (see FIG. 5). The casket enclosure 10 is preferably made from a single sheet of a thermoplastic resinous material which is impermeable to both gases and liquids and which is resistant to chemical attack by highly corrosive liquids that are used in the embalming process and particularly solutions of formaldehyde, for example. The thermoplastic resinous sheet material is heated to a softening temperature and is then formed into an elongated, generally rectangular configuration with opposite side edges 26, 28 of the sheet being brought together into abutting relationship along the bottom wall 14 where they are joined together to form an elongated seam 30 suitably by thermo-welding or chemical bonding as shall be described in greater detail hereinafter.

The casket enclosure 10 of the invention is preferably formed with truncated or chamfered top edges as shown at 32, 34 in order to remove sharp corners that might otherwise hinder insertion of the enclosure into the burial crypt (see FIG. 5) and also to add strength and rigidity to the structure. The thermoplastic resinous sheet material that is used in the fabrication of the casket enclosure 10 is relatively thin (e.g., about ⅛ inch in thickness) in order to keep it as lightweight as possible and to allow for easy handling of the enclosure during shipment, storage and entombment in a burial crypt. The sheet material is also flexible and pliable so that once the enclosure has been sealed, the enclosure walls will be allowed to yield and even bulge to some degree upon the build-up of decomposition gases inside the enclosure but yet will be strong enough to resist cracking or bursting under relatively high internal pressures.

As shown in FIGS. 2-4, inclusive, the open end of the casket enclosure 10 is enclosed and hermetically sealed after insertion of the entombment casket 24 according to the method of the invention to be hereinafter described, by means of a generally rectangularly shaped end cover 36. The end cover 36 is made from the same tough, flexible, gas and liquid impermeable, corrosive resistant thin wall, thermoplastic resinous sheet material used to fabricate the top, bottom and side walls of the enclosure 10 and is further provided with a generally U-shaped sealing channel 38 which extends continuously around the outer peripheral edge of the cover. The sealing channel 38 is located in a plane that is generally perpendicular to the flat planar surface of the end cover 36 and is so positioned and arranged as to receive in abutting relationship the outer peripheral edges of the top, bottom and opposite side walls 12, 14 and 16, respectively, which surround the open end 22 of the enclosure 10. As best seen in the view of FIG. 4, the sealing channel 38 is formed by an inner side wall 40 that extends outwardly from the cover 36 and a somewhat shorter, outer side wall 42. The two walls are spaced apart from each other a distance which is only slightly larger than the thickness of the thermoplastic resinous sheet material providing a small clearance around the juncture between the sealing channel 38 and the peripheral edges of the enclosure 10 which will permit penetration of a liquid or semi-liquid, paste-like solution containing a bonding agent as generally depicted by the reference numeral 46.

The bonding agent used in the practice of the invention is a chemical solvent which is capable of dissolving the thermoplastic resinous material used for both the enclosure walls and the end cover 36 and then providing a welded juncture upon curing over a relatively short period of time which is strong, impervious to gases and liquids and which is chemically resistant to corrosive liquids. In constructing a joint according to the invention, the solvent is first applied liberally within and around the continuous U-shaped, peripheral sealing channel 28, preferably as a viscous paste as at 46 in FIG. 4. The end cover 36 is then positioned over the open end 22 of the enclosure 10 (see FIG. 3) with the peripheral edges of the top, bottom and side walls 12, 14 and 16, respectively, fully inserted inside the channel 38. The structure is then allowed to stand a sufficient time to permit the solvent to dissolve portions of the thermoplastic, resinous sheet material that lie adjacent to one another inside the sealing channel 38 and to form a strong chemically bonded joint upon curing at room or ambient temperatures.

There are many thermoplastic resinous sheet materials on the market today, such as various grades of polystyrene, for example, which are strong and durable enough to employ in the fabrication of a lightweight, hermetically sealed casket enclosure. However, most of the these known thermoplastic materials are, unfortunately, not chemically resistant to solutions that are conventionally employed in the embalming process, notably formaldehyde, and consequently they are not suitable for use in a casket enclosure. It has been discovered according to the invention that an excellent thermoplastic resinous material which is strong and durable and which is chemically resistant to embalming solutions and therefore ideal for use in constructing casket enclosures is a styrenic resin based composition including essentially three monomers, namely acrylonitrile, butadiene and styrene. Each of the three major components brings a unique and different set of useful properties to the finished product. Acrylonitrile contributes chemical resistance and heat stability while butadiene provides impact resistance and toughness. The styrene component ensures rigidity and ease of processing during manufacture. These strong and durable, chemically resistant, thermoplastic resinous materials are produced under the trade name "ABS Resins" by the Dow Chemical Company, Plastics Department, Midland, Mich. Table I below lists some of the important physical properties of these resins:

TABLE I

| Physical Properties* | |
|---|---|
| Yield Tensile Strength | 3,400 lbs/sq. in. |
| Ultimate Tensile Strength | 3,600 lbs/sq. in. |
| Ultimate Elongation | 40% |
| Tensile Modulus | 280,000 lbs/sq. in. |
| Impact Strength | 1.8 ft. lbs/in. |
| Softening Point | 220 degrees F. |
| Flexural Strength | 7,000 lbs/sq. in. |
| Hardness | 108 Rockwell R |

*Compression Molded Values

It has been further discovered in accordance with the invention that when an acrylonitrile, butadiene and styrene containing resin (ABS) is employed to fabricate a casket enclosure 10 and the end cover 36 for closing its open end as described hereinabove, a particularly good chemical bonding agent for hermetically sealing the juncture between the peripheral edges of the enclosure and the U-shaped channel 38 is a ketone-containing solvent and especially methyl ethyl ketone. Solvents containing methyl ethyl ketone are readily available on the marketplace such as those produced commercially by the Shell Oil Company, Houston, Texas. These solvents are liquids at ambient temperatures having a boiling point of about 175 degrees F., a specific gravity of about 0.81 and a vapor pressure of about 70.2 millimeters of mercury at 68 degrees F. They react quite rapidly with the ABS resin to dissolve the same at room or ambient temperatures, taking about 15 minutes to partially solidify or set up to a semi-liquid state and about 24 hours to cure to full strength. Since the solvent is sold commercially as a liquid, it may be desirable to thicken the solvent to the consistency of a semi-liquid or paste by the addition of unreacted resin chips (ABS). The paste should flow easily throughout the juncture under moderate pressure and remain in place without running or spilling and possibly destroying the integrity of the bonded joint after the dissolved resin has been cured.

Figure 5:
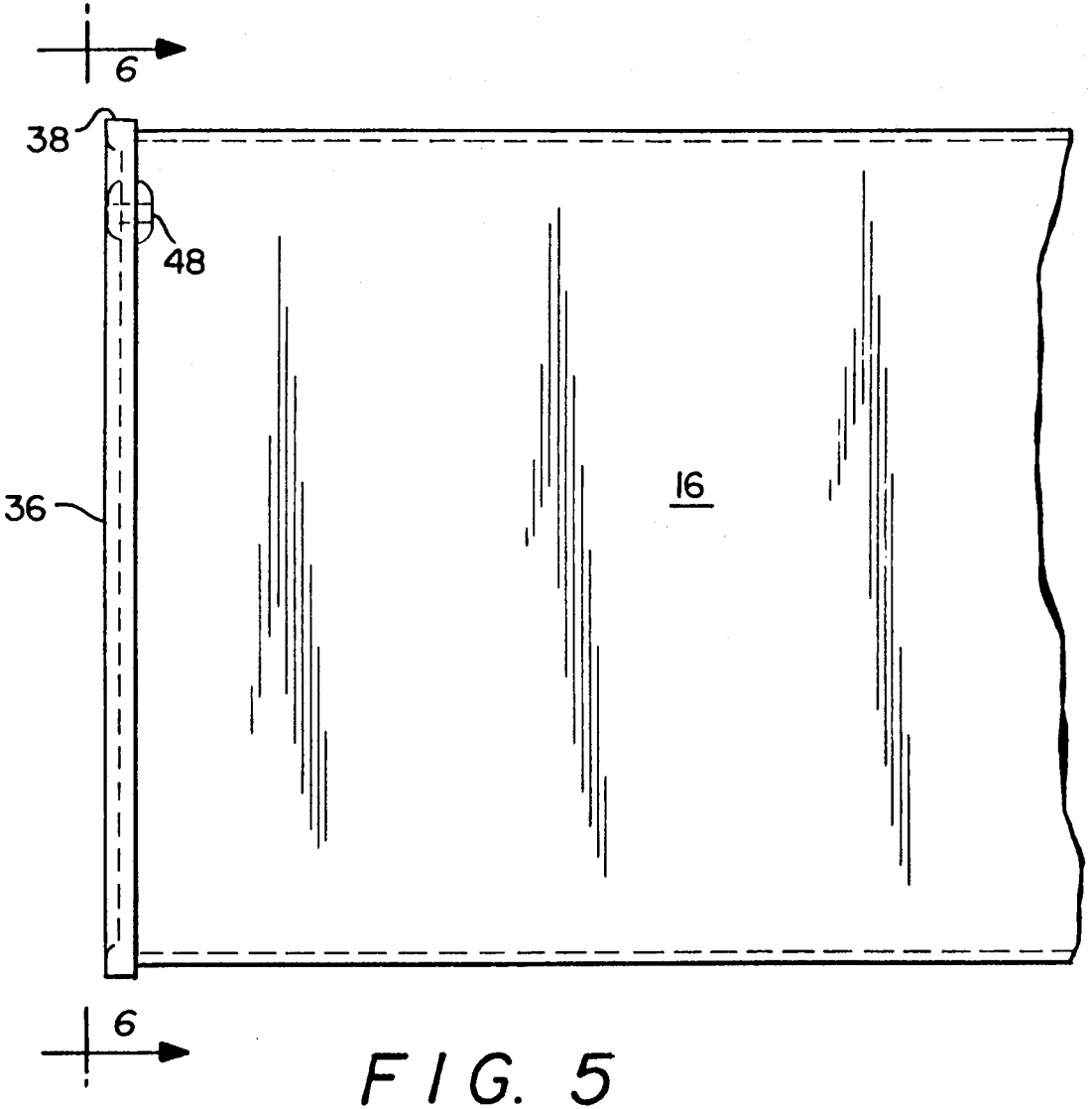
FIG. 5 is an enlarged elevational view of the opposite end of the casket enclosure which is closed by an end cover including a pressure relief valve.
Figure 6:
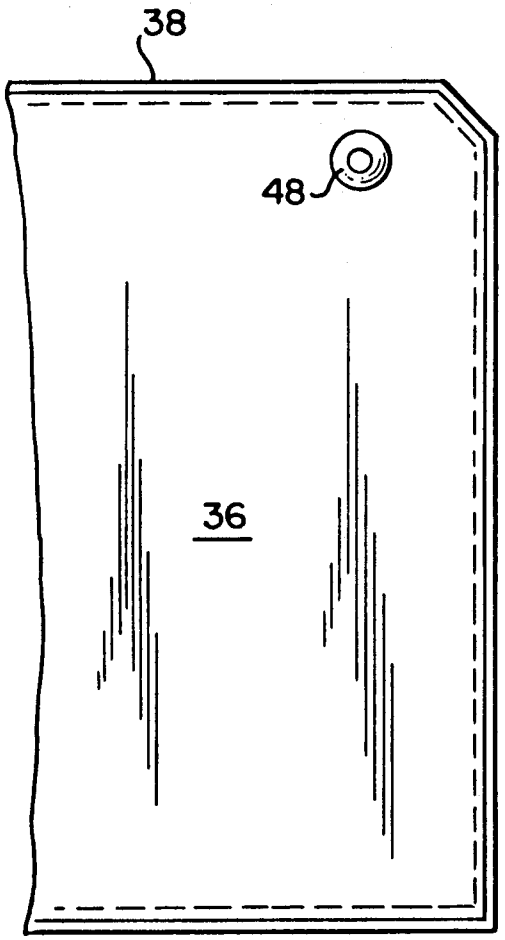
FIG. 6 is an enlarged fragmentary view of the end cover taken along the line 6—6 in FIG. 5.
Figure 7:
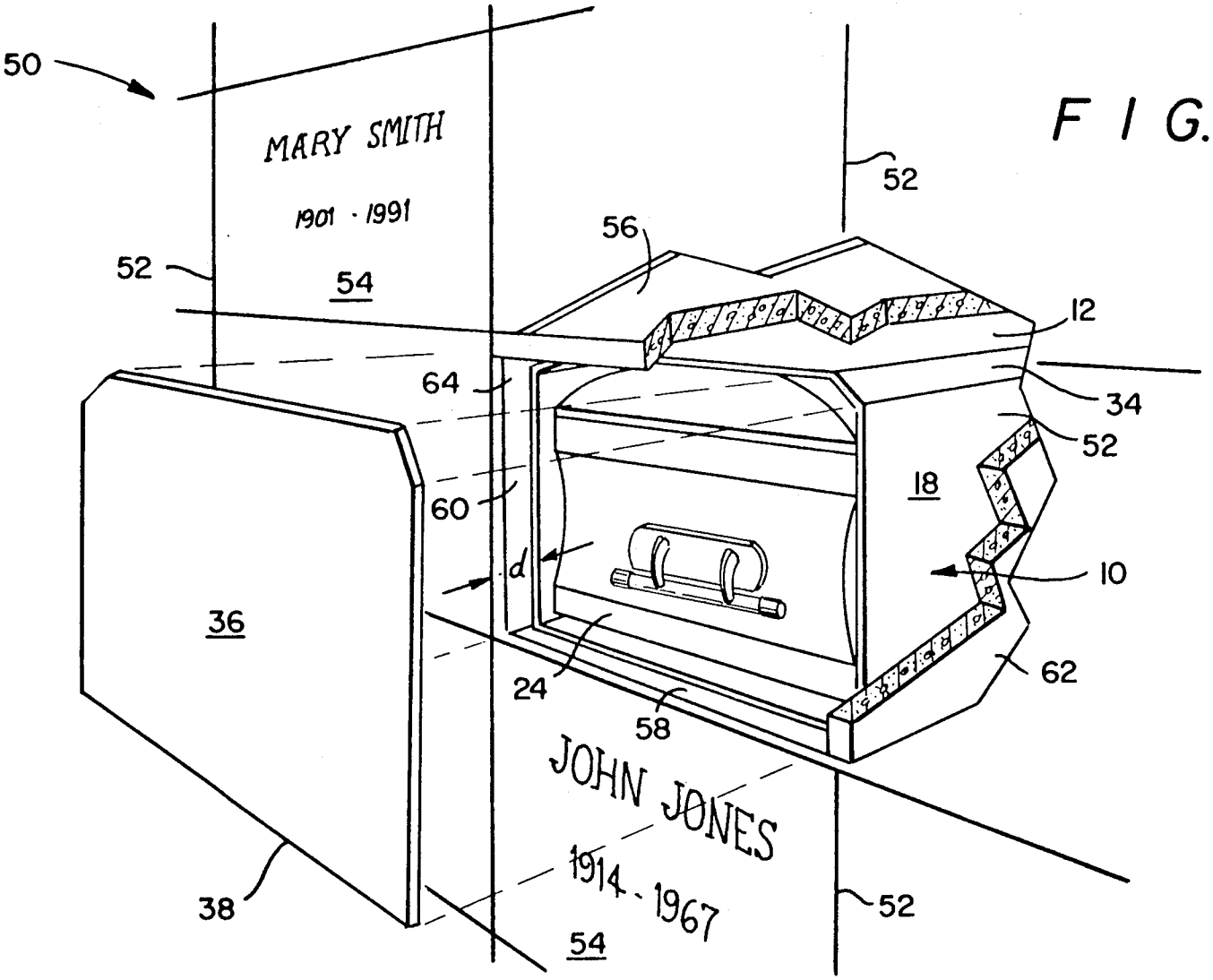
FIG. 7 is a perspective view of a typical burial crypt partly broken away to show a crypt chamber containing a casket enclosure embodying the invention, the casket enclosure including an end cover shown in exploded assembly in order to illustrate details of the casket and method of storing the same in the burial crypt.

The other end of the casket enclosure 10 may be closed using the same type of end cover 36 as shown in FIGS. 5 and 6. However, the end cover 36, in this case, may be hermetically sealed by any of the well known methods such as by heat sealing the peripheral edges of the enclosure within the U-shaped sealing channel 38. Alternatively, the end cover 36 at the other or opposite end of the enclosure 10 may be hermetically sealed using the same chemical bonding agent according to the invention as described hereinabove. Also as shown in FIGS. 5 and 6, the end cover 36 may be provided with an optional safety relief valve 48 in order to release gases from inside the casket enclosure 10 once the internal gas pressure has reached a predetermined set level. The safety relief valve may of course be incorporated in either end cover as well as the top and side walls of the enclosure.

The invention further provides a method for storing an enclosed, entombment casket in an above ground burial vault or crypt which is easy to carried out in a relatively short period of time as compared to the prior art methods and which does not require that the casket enclosure be completely sealed hermetically before the casket and the enclosure are placed inside the crypt chamber. FIG. 5 shows in detail the structure of a typical burial crypt generally designated at 50, which includes a plurality of individual crypt chambers 52, some of which are occupied by the remains of persons whose names appear on the front or facial plates 54. For purposes of illustration, part of the crypt 50 is cut away to illustrate the construction of a typical crypt chamber which, as shown, is a generally elongated, rectangular configuration having a top wall 56, a bottom wall 58 and opposite side walls 60, 62, all of which are typically constructed of concrete. The first step in carrying out the method of the invention is to insert the empty casket enclosure 10 completely inside the crypt chamber 52 as shown in the view of FIG. 5. As described hereinabove, the casket enclosure 10 is also of a generally elongated, rectangular configuration and is dimensioned to fit compactly within the crypt chamber 52 with a minimum of clearance, about two inches, for example, between the enclosure and the chamber walls, except of course for the bottom wall upon which the enclosure will rest, in order to save space throughout the burial crypt. The open end of the casket enclosure 10 which will be located farthest from the entrance 64 of the crypt chamber 52 is hermetically sealed prior to inserting the enclosure inside the crypt chamber. This open end of the enclosure 10 may be sealed, for example, using the same type of end cover 36 as shown in FIGS. 5 and 6. As already mentioned, the end cover may be hermetically sealed by heat sealing the peripheral edges of the enclosure 10 to the channel 38 or the enclosure may be sealed using a chemical bonding agent according to the invention. The empty casket enclosure 10, as described above, is inserted completely inside the crypt chamber 52 and has its opposite open end spaced backwardly from the entrance 64 a distance "d" which may be an inch or two, for example, to allow room for the end cover 36. The enclosed, entombment casket 24 is then placed or inserted inside the empty casket enclosure 10 through the open end thereof. The next step is to hermetically seal the open end of the now occupied casket enclosure 10 using the end cover 36 which is shown in exploded position just to the left of the chamber entrance 64. A chemical bonding agent, e.g., methyl ethyl ketone paste, is next applied liberally within and around the U-shaped channel 38 in the same manner as described hereinabove. The end cover 36 is then placed over the open end of the casket enclosure 10, taking care that the peripheral edges of the top, bottom and opposite side walls 12, 14 and 16, respectively, enter and mate with the U-shaped channel 38. Sufficient pressure is then applied around the periphery of the end cover 36 in order to ensure that a good, tight contact is achieved between the U-shaped channel 38 and the peripheral edges of the casket enclosure 10. The front or facial plate 54 of the crypt chamber 52 may then be sealed in place at the entrance 64 or, if desired, the plate may be set aside for a short period of time and the sealed juncture checked for effectiveness before the crypt chamber is closed.

Although the invention has been described herein with particular reference to a preferred embodiment of a compact, lightweight, hermetically sealed casket enclosure according to the invention, it will be understood that the casket enclosure can be modified in a number of ways without departing from the spirit and scope of the invention. For example, it is possible to incorporate a sealing channel or similar structure around the open end of the enclosure and to seal the peripheral edges of the end cover within the channel using the same chemical bonding agent as described above. Other similar modifications will, of course, occur to those skilled in the art.

What is claimed is:

1. A method of storing an enclosed entombment casket in a crypt chamber of a generally rectangular configuration having rigid top, bottom and side walls and having an opening at one end serving as the entrance to said crypt chamber, comprising the steps of:

(a) placing within said crypt chamber an empty, generally rectangular casket enclosure made from a thermoplastic resinous sheet material, said casket enclosure having top, bottom and side walls that are dimensioned so that said enclosure fits compactly within said crypt chamber, said enclosure having an open and a closed end and being positioned within said crypt chamber with said open end spaced apart a distance from said entrance opening so that said enclosure is completely contained within said chamber;

(b) inserting the enclosed entombment casket within said empty casket enclosure through said open end thereof after said casket enclosure has been placed within said crypt chamber;

(c) closing said open end of said casket enclosure in place within said crypt chamber by placing over said open end a cover made from said thermoplastic resinous material, said cover being disposed around its outer periphery in abutting relationship with portions of said top, bottom and opposite side walls of said enclosure surrounding said open end; and (d) sealing said abutting portions of said enclosure and said cover by placing therebetween a chemical bonding agent capable of dissolving said thermoplastic resinous material and forming a chemical bond which is strong, resistant to chemical attach and which is impervious to both gases and liquids.

2. A method according to claim 1, wherein said thermoplastic resinous sheet material is a styrenic resin based composition including monomers of acrylonitrile, butadiene and styrene.

3. A method according to claim 2, wherein said chemical bonding agent is methyl ethyl ketone.

4. A method according to claim 3, wherein said cover is provided with a generally U-shaped sealing channel around its outer periphery which is adapted to receive in abutting relationship the peripheral edges of said top, bottom and opposite side walls of said enclosure.

5. A method according to claim 4, wherein particles of said styrenic resin are admixed with said methyl ethyl ketone to provide a semi-liquid paste prior to applying between the peripheral edges of said enclosure and said end cover.

6. A method according to claim 5, wherein said paste is applied liberally within and around said U-shaped channel prior to applying said end cover to said enclosure.

7. A method according to claim 1, wherein the opposite end of said enclosure is hermetically sealed using an end cover prior to placing said enclosure within said crypt chamber.

8. In combination, a burial crypt including at least one crypt chamber of a generally elongated configuration having rigid top, bottom and side walls and having an open end constituting an entrance to said crypt chamber; a casket enclosure for storing an enclosed entombment casket in said crypt, said casket enclosure having a generally rectangular configuration including top, bottom and side walls which are made from a thermoplastic resinous material containing monomers of acrylonitrile, butadiene and styrene and which are dimensioned so that said enclosure fits compactly within said crypt chamber, said casket enclosure having an open and a closed end; and an end cover adapted to fit over said open end of said enclosure, said end cover having a substantially U-shaped channel disposed around its outer periphery which receives in abutting relationship the peripheral edges of said top, bottom and side walls of said enclosure surrounding said open end, the juncture between said abutting peripheral edges of said enclosure and said cover being gas and liquid tightly sealed by a chemical bond therebetween formed by reacting said thermoplastic material with a solvent capable of dissolving said material, said chemically bonded juncture being strong and resistant to chemical attack and being impervious to both gases and liquids.

9. The combination according to claim 8, further including a safety relief valve in said casket enclosure.

10. A casket enclosure comprising a box-like container having a generally elongated, rectangular configuration including top, bottom and side walls which are made from a thermoplastic resinous material containing monomers of acrylonitrile, butadiene and styrene, said enclosure having an open and a closed end; an end cover adapted to fit over said open end of said enclosure, said end cover being made from said thermoplastic resinous material and having a substantially U-shaped channel disposed around the peripheral edges thereof which receives in abutting relationship the peripheral edges of said casket enclosure surrounding said open end, the juncture between said abutting peripheral edges of said enclosure and said U-shaped channel being gas and liquid tightly sealed by a chemical bond therebetween formed by reacting said thermoplastic material with a solvent capable of dissolving said material, said chemically bonded juncture being strong and resistant to chemical attack and being impervious to both gases and liquids; and a safety relief valve mounted in said closed end.

11. A method of storing an enclosed entombment casket in a crypt chamber of a generally rectangular configuration having rigid top, bottom and side walls and having an opening at one end serving as the entrance to said crypt chamber, comprising the steps of:

(a) placing within said crypt chamber an empty, generally rectangular casket enclosure made from a thermoplastic resinous sheet material, said casket enclosure having top, bottom and side walls that are dimensioned so that said enclosure fits compactly within said crypt chamber, said enclosure having an open and a closed end and being positioned within said crypt chamber with said open end spaced apart a distance from said entrance opening so that said enclosure is completely contained within said chamber;

(b) inserting the enclosed entombment casket within said empty casket enclosure through said open end thereof after said casket enclosure has been placed within said crypt chamber;

(c) providing a cover for sealing said open end of said casket enclosure, said cover being made from the same thermoplastic resinous sheet material as used for said casket enclosure, said cover having a substantially U-shaped channel disposed around the peripheral edges thereof which is adapted to receive in abutting relationship the peripheral edges of said top, bottom and side walls of said enclosure surrounding said open end;

(d) applying a sealing paste liberally within and around said U-shaped channel, said paste containing a solvent capable of dissolving said thermoplastic resinous material and forming a chemically bond which is strong, resistant to chemical attack and which is impervious to both gases and liquids;

(d) placing said cover over said open end of said casket enclosure with said peripheral edges of said enclosure fitting inside said U-shaped channel in abutting relationship therewith and contacting said paste; and (e) allowing sufficient time for said solvent to dissolve said thermoplastic resinous material and form a chemical bond between said U-shaped channel and said peripheral edges of said enclosure.

12. A method according to claim 11, wherein said thermoplastic resinous material is a styrenic resin based composition including monomers of acrylonitrile, butadiene and styrene.

13. A method according to claim 12, wherein said solvent is methyl ethyl ketone.

14. A method of storing an enclosed entombment casket in a crypt chamber of a generally rectangular configuration having rigid top, bottom and side walls and having an opening at one end serving as the entrance to said crypt chamber, comprising the steps of:

(a) placing within said crypt chamber an empty, generally rectangular casket enclosure made from a thermoplastic resinous sheet material comprising a styrenic resin based composition including monomers of acrylonitrile, butadiene and styrene, said casket enclosure having top, bottom and side walls that are dimensioned so that said enclosure fits compactly within said crypt chamber, said enclosure having an open and a closed end and being positioned within said crypt chamber with said open end spaced apart a distance from said entrance opening so that said enclosure is completely contained within said chamber;

(b) inserting the enclosed entombment casket within said empty casket enclosure through said open end thereof after said casket enclosure has been placed within said crypt chamber;

(c) providing a cover for sealing said open end of said casket enclosure, said cover being made from the same thermoplastic resinous material as used for said casket enclosure, said cover having a substantially U-shaped channel disposed around the peripheral edges thereof which is adapted to receive in abutting relationship the peripheral edges of said top, bottom and side walls of said enclosure surrounding said open end;

(d) preparing a sealing paste comprising particles of said thermoplastic resinous material and a solvent containing methyl ethyl ketone;

(e) applying said sealing paste liberally within and around said U-shaped channel;

(f) placing said cover over said open end of said casket enclosure with said peripheral edges of said enclosure fitting inside said U-shaped channel in abutting relationship therewith and contacting said paste; and (g) allowing sufficient time for said solvent to dissolve said thermoplastic resinous material and form a chemical bond between said U-shaped channel and said peripheral edges of said enclosure.

* * * * *